United States Patent [19]

Reash

[11] 3,939,376

[45] Feb. 17, 1976

[54] ALIGNMENT SPRING COUNTERACTING ANTENNA TYPE GETTER EFFECT ON ELECTRON GUN ALIGNMENT

[75] Inventor: Clair W. Reash, Fairview Park, Ohio

[73] Assignee: Union Carbide Corporation, New York, N.Y.

[22] Filed: Dec. 26, 1974

[21] Appl. No.: 536,619

[52] U.S. Cl. ..... 313/451; 313/481

[51] Int. Cl.[2] H01J 29/02; H01J 29/70; H01J 29/82

[58] Field of Search ..... 313/481, 451, 456, 178, 313/482, 417

[56] References Cited

UNITED STATES PATENTS

| | | | |
|---|---|---|---|
| 2,877,370 | 3/1959 | Hanson | 313/456 |
| 3,508,105 | 4/1970 | Pappadis | 313/178 |

*Primary Examiner*—Robert Segal

*Attorney, Agent, or Firm*—Frederick J. McCarthy

[57] ABSTRACT

A picture tube containing an electron gun assembly and an attached antenna type getter is provided which a spring like support member to maintain axial alignment of the electron gun assembly in the picture tube.

1 Claim, 5 Drawing Figures

ALIGNMENT SPRING COUNTERACTING ANTENNA TYPE GETTER EFFECT ON ELECTRON GUN ALIGNMENT

The present invention relates to an improved getter assembly for use in television picture tubes. More particularly the present invention is directed to a getter assembly which maintains axial alignment of an electron gun assembly in a picture tube, in particular color television picture tubes.

In the manufacture of television picture tubes the necessary vacuum is obtained through the use of getters, ordinarily barium getters, whereby barium is flashed or varporized within the picture tube. The vaporized getter material, e.g., barium, sorbs and reacts with the residual gases in the picture tube and removes them as low vapor pressure solid condensates. Also, the barium which is deposited on the interior surfaces of the picture tube continues to sorb gases which may be liberated during use of the picture tube.

In the past, getter devices, commonly in the form of ring shaped containers, were mounted in the neck portion of the picture tube. However, for various practical reasons, it is now the usual practice to position the getter container on the inside surface of the funnel portion of the picture tube.

The getter container is so positioned by means of an elongated spring member, often called an "antenna", which is attached at one end to the electron gun assembly, located in the neck of the picture tube, and at the other end to the getter container which is forcibly held against the funnel portion of the picture tube. The force of the funnel portion acting against the getter container imparts a force on the electron gun which, unless compensated, tends to undesirably misalign the electron gun assembly in the neck portion of the picture tube.

It is an object of the present invention to provide an arrangement which maintains the axial alignment of the electron gun assembly in a picture tube employing an antenna getter.

Other objects will be apparent from the following description and claims taken in conjunction with the drawing in which FIG. 1 shows a conventional arrangement of an antenna getter in connection with an electron gun assembly in a picture tube FIG. 2 shows the arrangement of FIG. 1 with the addition of a spring like arrangement in accordance with the present invention to maintain axial alignment of the electron gun in the neck of the picture tube FIG. 2*a* shows isometrically a portion of the arrangement of FIG. 2

Figure 1:
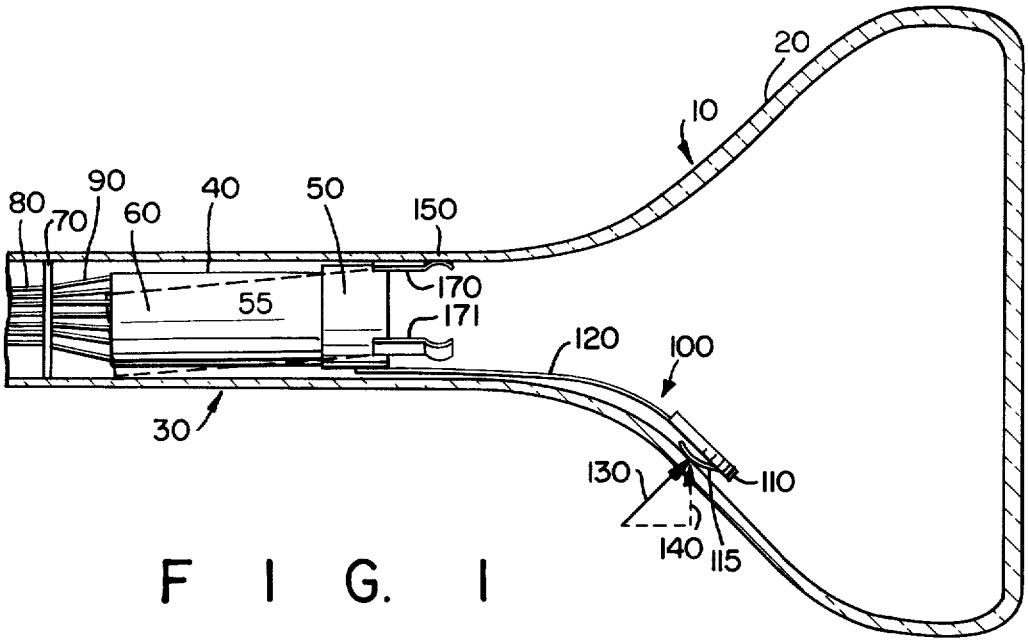

With reference to FIG. 1, a picture tube is indicated at 10 having a funnel portion 20 and a cylindrical neck portion 30. An electron gun assembly is shown at 40 including a metal convergence cup member 50, lens portion 60 and glass header 70 having pin leads 80 which electrically connect to the electron gun via connectors 90. An antenna type getter 100 is shown comprising getter container 110 and extended spring member 120 which is fixedly attached to metal cup member 50 and getter container 110. Spring member 120 forcibly holds getter container 110 adjacent the funnel portion of the picture tube as indicated. Getter container 110 is provided with a sled type support as indicated at 115. The force of the tube surface against getter container 110, via sled support 115, is indicated at 130, with the vertical component of this force being indicated at 140. Force component 140 imparts a rotational force to the electron gun assembly 35 about point 150 which is the contact of spacer spring member 170 with the surface of the picture tube envelope. Spacer spring 170 is one of three conventional spacer springs, 170, 171, 172, fixedly attached to the periphery of cup member 50 which serve to locate cup member 50 centrally in the neck portion of the picture tube. However, the vertical force component 140 tends to cause the electron gun assembly 40 to rotate about point 150 and assume a position indicated by the dotted lines 55 in FIG. 1 which causes misalignment of the electron gun. This condition occurs prior to the sealing of header 70 to the neck of the picture tube which is conventionally accomplished by heating the tube adjacent header 70 to fuse and seal the header to the cylindrical neck portion 30 of tube 10.

Figure 2:
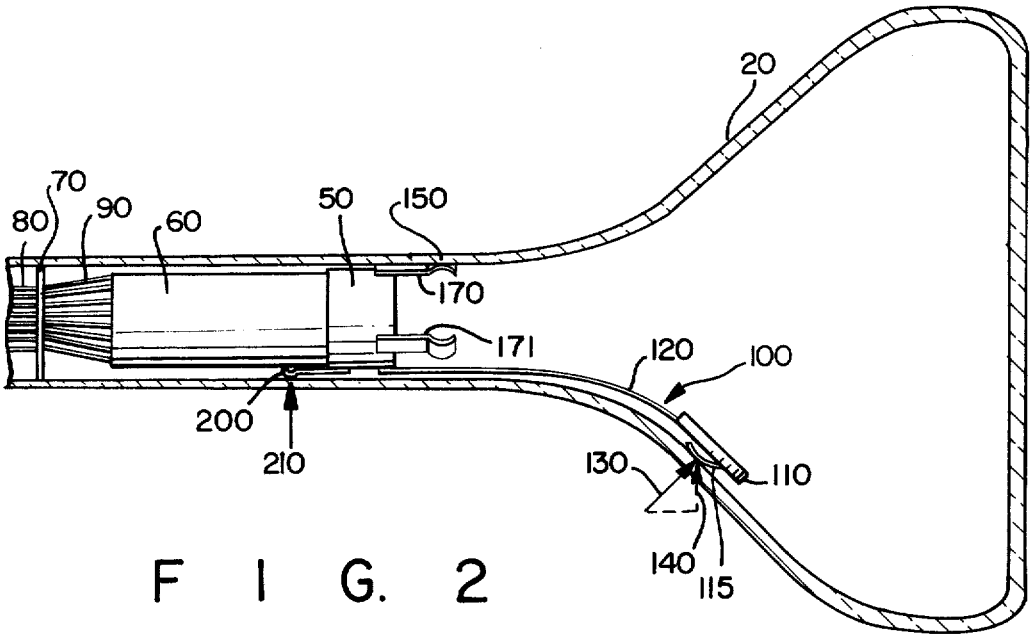
Figure 2A:
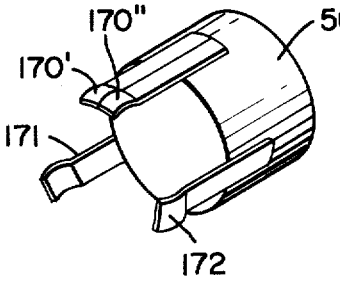

To prevent electron gun misalignment in accordance with the present invention, an extended spring member 200 is attached to cup member 50 extending toward header member 70 as shown in FIG. 2 to provide a rotational force 210 which balances the rotational force component 140 due to the antenna getter arrangement as noted hereinabove. The moments forces 210 and 140 are balanced about fulcrum point 150 noted above. This arrangement avoids misalignment of the electron gun assembly 40; however, the force acting upward against spacer spring member 170 at point 150 has been thus increased and spacer 170 must be of a design which will accommodate the increase upward force such that an overall upward vertical displacement of electron gun assembly 35 does not occur. One way of accomplishing this is to provide two spring spacers 170' and 170'' at point 150 as indicated in FIG. 2(a) in place of the single spring spacer 170 to distribute the increased force. Material of appropriate modulus of elasticity can be used for spacer 170 to provide the same result.

Figure 4:
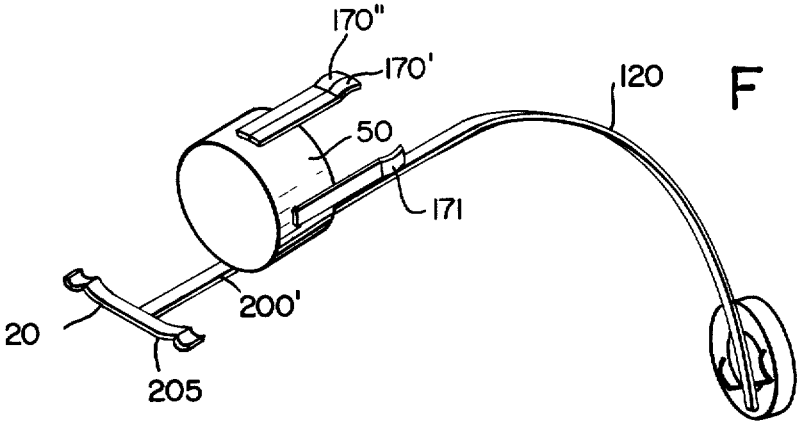
FIG. 4 shows isometrically a portion of the arrangement of FIG. 3.
Figure 3:
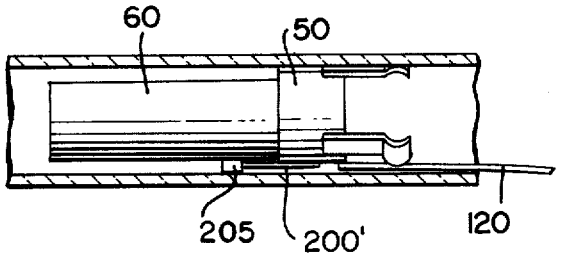
FIG. 3 shows a further embodiment of the present invention.

FIG. 3, and FIG. 4 which isometrically shows a portion of the arrangement of FIG. 3 shows the extended spring member 200' is provided with lateral extensions 205 and 206 which provide an additional measure of alignment stability.

Spring member 200 designed as illustrated so that is slidable on the surface of the tube neck to facilitate insertion of the assembly into the picture tube. Spring member 200 can be an extended portion of the extended spring member 120 of the antenna getter; however, it is frequently better to have extended spring member 200 as a separate part since increased modulus of elasticity can enable the use of a shorter member 200 which is important in avoiding contact with lens portion.

The length and shape of member 200 can be routinely determined by measurement of the rotational moment about point 150 due to force 140 for a given picture tube-electron gun arrangement and selecting an appropriate, moment arm and force required to balance this rotational force.

While the foregoing description has been particularly directed to a sled supported getter, the present invention is applicable to other getter supporting arrangements known to art, e.g. ceramic disk supports.

What is claimed is:

1. In a picture tube having a cylindrical neck portion and a conical funnel portion and containing an electron gun assembly including a glass header member adapted to seal the neck portion, a cylindrical metal cup member said cup member being held centrally spaced in said neck portion by peripherally attached spring members, a getter assembly attached to said cup member by an elongated spring member which forcibly holds said getter assembly against the funnel portion of said tube and imparts a rotational force on said electron gun assembly, the improvement which comprises at least one spring member attached to said cup member and extending toward said header member and forcibly contacting said neck portion of said picture tube and imparting a force on said electron gun assembly which substantially balances said rotational force due to said elongated spring member attached to said getter assembly, said peripherally attached spring members compensating for the increased force applied to the electron gun assembly by said spring member attached to said cup member to maintain said electron gun in axial alignment in said neck portion of said picture tube.

* * * * *